United States Patent [19]

van Schie

[11] 4,399,980

[45] Aug. 23, 1983

[54] OBSTACLE PROTECTOR MEANS

[75] Inventor: Theodorus J. M. van Schie, 's-Gravendeel, Netherlands

[73] Assignee: Staat der Nederlanden, Netherlands

[21] Appl. No.: 276,706

[22] Filed: Jun. 23, 1981

[30] Foreign Application Priority Data

Jun. 24, 1980 [NL] Netherlands ..... 8003653

[51] Int. Cl.[3] ..... E01F 15/00

[52] U.S. Cl. ..... 256/13.1; 188/377

[58] Field of Search ..... 256/1, 13.1, 19; 188/371, 377

[56] References Cited

U.S. PATENT DOCUMENTS 3,944,187 3/1976 Walker ..... 256/1 X
3,982,734 9/1976 Walker ..... 256/13.1
4,101,115 7/1978 Meinzer ..... 256/13.1
4,321,989 3/1982 Meinzer ..... 256/13.1 X

FOREIGN PATENT DOCUMENTS 1492752 11/1977 United Kingdom ..... 188/377

*Primary Examiner*—Richard J. Scanlan, Jr.
*Attorney, Agent, or Firm*—Basile, Weintraub & Hanlon

[57] ABSTRACT

An obstacle protection arrangement composed of a series of interconnected deformable segments, each comprising a U-shaped support member and a box structure containing crumpling tubes. Both sides of the arrangement are formed by overlapping flank members such that during a front collision there will be dissipation of energy by deformation of the segments, whereas during a side collision the arrangement behaves like a rigid girder.

6 Claims, 17 Drawing Figures

OBSTACLE PROTECTOR MEANS

BACKGROUND OF THE INVENTION

1. Field of the Invention

The present invention relates to an obstacle protection arrangement comprising a deformable spatial structure wherein a dissipation of energy is brought about during a deformation resulting from a collision with a moving object (a road vehicle), which arrangement is composed of a series of segments which are interconnected—in the anticipated direction of motion—and which are each comprised of at least one gate-shaped support member standing on the ground and positioned transversely to said direction, as well as of a box-like structure fastened thereto and internally provided with deformation elements, a flank member being affixed on both sides of each segment.

2. Description of the Prior Art

A specific embodiment of such an arrangement is known from U.S. Pat. Nos. 3,982,734 and 3,944,187. The main purpose is to protect solitary obstacles by roadsides in such a manner that vehicles that have moved off the roadway are prevented from coming into contact with such obstacles. It occurs not infrequently that such solitary obstacles are located in the pointed area of road exits or in the continuous shoulder along the roadway.

The protection of an obstacle may be achieved in two ways. In the event of a collision occurring on the nose portion of the obstacle protector means, the vehicle is to be stopped prior to touching the obstacle to be protected. If a collision occurs with the flank of the obstacle protector means, the travelling direction of the vehicle must be changed so as to guide it past the obstacle. In both such cases the occupants of the vehicle should not be exposed to intolerably high decelerations.

In practice obstacle protectors are known to exist which offer none or unsuitable flank protection. Also, several types of obstacle protection arrangements often require an elaborate foundation and anchoring. In addition, various types of known obstacle protectors either do not correctly function in an optimum fashion in the event of a head-on collision when its parallel structure is altered into a V-shape, for example, when placed in a gore area.

SUMMARY OF THE INVENTION

The object of the invention is to provide an improved arrangement which can be used in a V-form for a pointed area at an exit, but also in a parallel form in the shoulder along the roadway. In addition, it is an object of the invention to provide an arrangement which is adaptable to the local conditions and which affords easy mounting and whose cost is relatively low. These and other objects are attained according to the invention by using an obstacle protector means which—as viewed in the intended direction of traffic motion—has its rear support member fastened to a foundation, the front support member being located in a horizontal guideway allowing displacement in the direction of motion only, whilst the segments are rigidly coupled to one another, so that the whole arrangement behaves like a rigid girder.

These features lead to a construction of an obstacle protector means which affords a high degree of rigidity against bending both in a horizontal and in a vertical plane so that two points of foundation are sufficient.

The obstacle protector means is composed of a number of standard units or segments, which makes it possible to adapt the obstacle protector to the local situation in terms of absorbing capacity. The degree of energy absorption may be adapted to the local conditions as anticipated by varying, in addition to having the choice of number of segments, the dimensions and compositions of the material of the deformation elements disposed within the box-like structure, as well. In this manner it is possible to assemble successive types of obstacle protectors as a function of the mass and speed of the passing vehicles. Due to the construction with segments, a damaged obstacle protector means according to the invention has a decided residual value, since the parts that have been slightly damaged or have remained undamaged can be used again. The V-shaped embodiment as used in a pointed area may, in the presence of a guide rail construction, be linked up thereto via one or both of the flank members.

In the event of a collision with the nose portion, the segments are successively compressed, starting with the nose segment. Such compression of segments is possible because the flank members when being displaced can pass one another and the box-like structure can be compressed. The deformation of the box-like structure in particular provides the greatest absorption of the kinetic energy of the vehicle.

A most efficient solution for providing for an appropriate energy-absorbing capacity of the box-like structure is obtained by providing the box-like structure with crumpling or ripple tubes which absorb the major portion of the energy in a collision. If needs be, it is possible to increase the deformation resistance of the successive segments—as viewed in the direction of motion—by using more ripple tubes.

In order that the ripple tubes may function without disturbances occurring, the top and bottom side of the box-like structure are beaded a little outwardly, at least one rod being disposed between these expanded areas. This form of construction is also favorable when transporting the individual box-like structures, and prevents damage due to vandalism. According to a particular embodiment, each segment is provided with flank members provided with longitudinal undulations engaging one another. Such members extend on both extremities past the respective segment so that there is an overlapping with neighboring flank members, in which case the connection of the adjoining segments is also carried through by means of at least one double-angled strip forming a connection with the support member. The strip affords a change in the mutual position on the one hand, but no substantial change in the angle of the flank extremities since an extra flange part forms a guide when the flank members are sliding past each other. This is important because upon impact, the divergence of the flank member should not result in the occurrence of laterally directed spearheads formed by the extremities of the flank members.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF PREFERRED EMBODIMENTS

Figure 1:
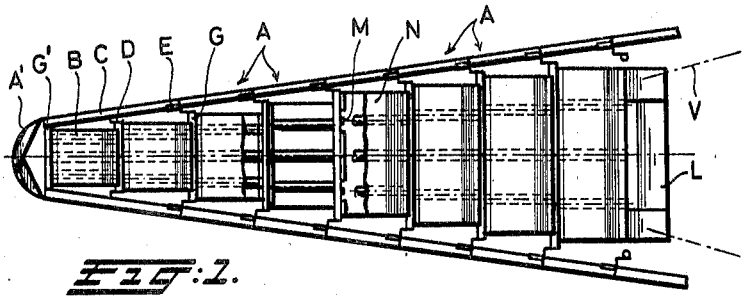
FIG. 1 is a top view of a diverging obstacle protector means to be used for the protection of an obstacle in a pointed area.
Figure 2:
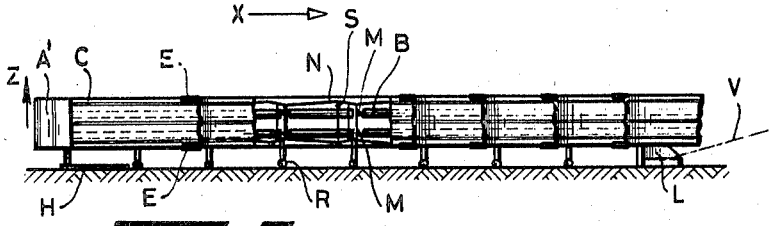
FIG. 2 is a side view of the arrangement according to FIG. 1.
Figure 3:
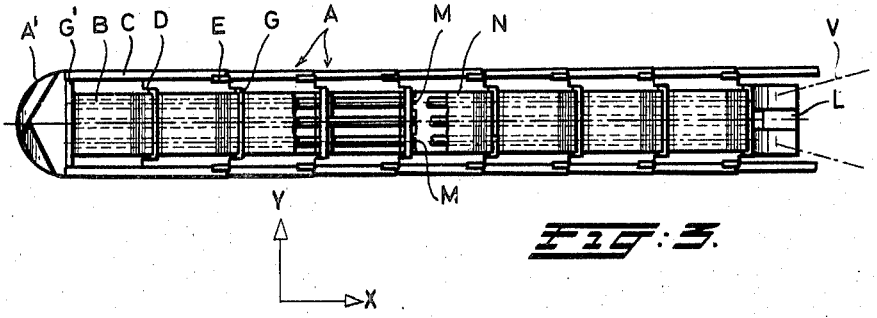
FIG. 3 is a top view similar to FIG. 1 of an obstacle protector means having a parallel form as is to be used for the shoulder along the roadway.
Figure 4:
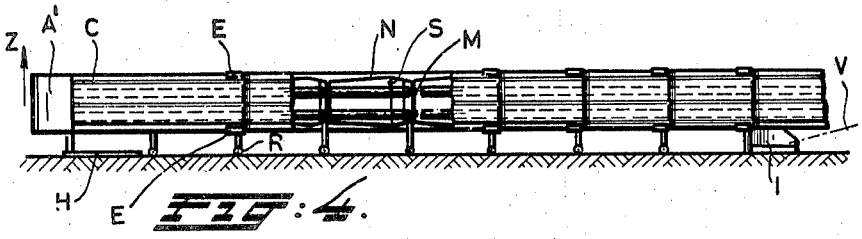
FIG. 4 is a side view of the arrangement according to FIG. 3.

As can be seen best in the FIGS. 1, 2 and 3, the obstacle protector means is comprised of a series of interconnected segments A provided with a nose segment A'. Each segment is composed of a U-shaped support member G disposed transversely to the direction of motion X and provided for fastening an internal box-like structure N thereto. The support members G are slidably or rollably supported on the ground, such as by rollers R, with the exception of the rearmost segment which is attached to a fixed foundation L. Also, tie members V which are to absorb the longitudinal forces occurring in the associated guide rail construction are attached to the foundation L. The nose segment A' is provided with a guide member H, as shown in FIG. 2, which prevents displacement in any direction other than the direction of travel X (see FIGS. 8*a* and *b*).

Figure 11:
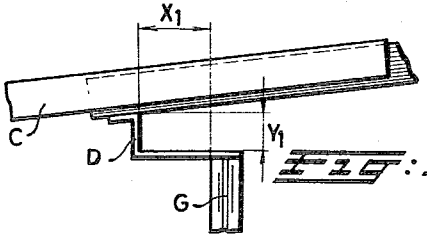
FIGS. 10–12 show the double-angled strip of the obstacle protector means of the invention.
Figure 12:
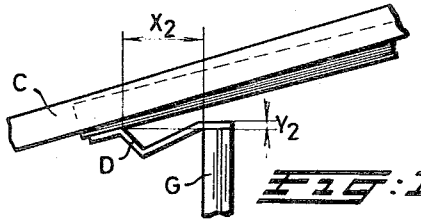
Figure 10:
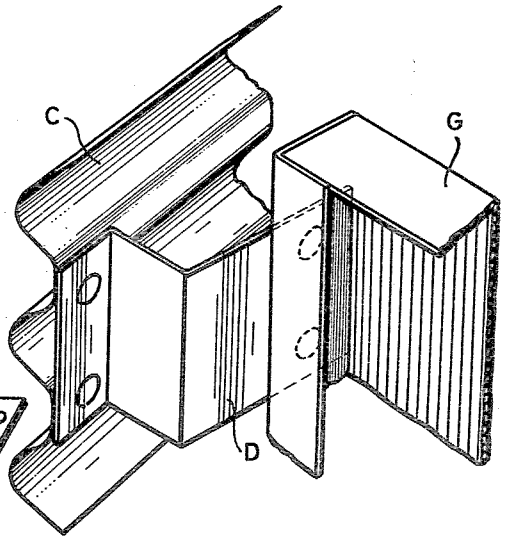

Each segment is provided on both sides with a flank member C which is connected to the associated support member G via an angled strip D. The shape and function of these strips D are illustrated in FIGS. 10–12. On the bending lines of the strip it is possible to provide weakened sections, for instance bore holes. These strips afford a shifting of successive flank members C past one another during a collision. The support members G move along thus causing a certain degree of transversely directed deflection to occur so that no wedging action takes place. The flank members C will not diverge sidewardly, which is also in the interest of preventing damage to vehicles of third parties or injury to the latter.

Figure 9:
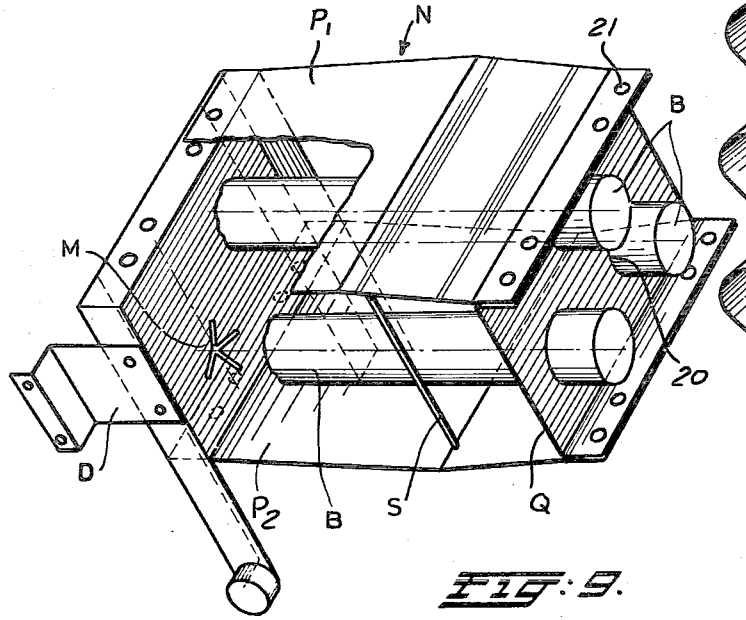
FIG. 9 is a perspective view of the box-like structure of FIG. 6 with edge faces being partially cut out.

FIG. 9 clearly shows that each box-like structure N is provided with crumpling or ripple tubes B. The purpose of these tubes is to absorb the major portion of the kinetic energy of the colliding vehicle. In addition, the box-like structure N imparts stability to the entire structure, specifically, at the occurence of lateral forces (see FIGS. 13 and 14). The box-like structure N facilitates transport and assembly of the obstacle protector means.

Figure 17A:
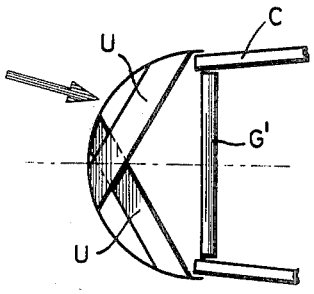
FIGS. 17*a* and 17*b* show the results of an eccentric impact upon the nose segment.
Figure 17B:
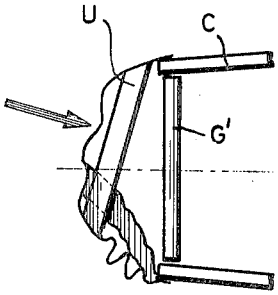
Figure 16A:
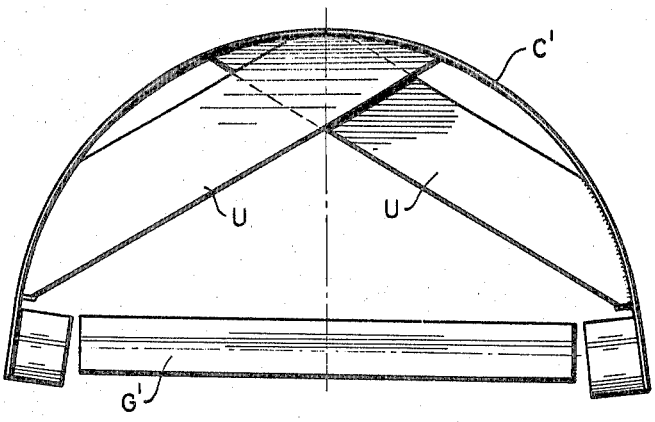
FIGS. 16*a*, 16*b*, 16*c* provide three views of a nose segment.
Figure 16B:
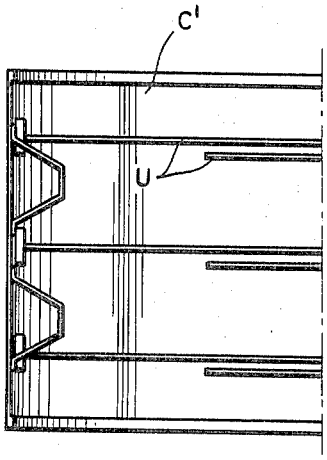
Figure 16C:
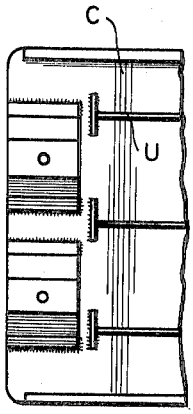

The construction of the nose segment A' is best apparent from the FIGS. 8*a*, 8*b*, 16*a*, 16*b* and 16*c*. There is an arcuate nose apron C' which may be regarded as a complement to the flank members C ending in each segment A. A support member G' cooperates on its lower side with a foundation guide member H. Inside the nose apron C' there are provided several straight thin plates U (see FIGS. 16*a*, 16*b* and 16*c*). This enables the nose segment at the beginning of the collision to adopt the shape and/or deformation of the vehicle in a manner so that the deformative force of the nose segment is lower than the threshold value of the ripple tubes. This causes the deforming of the first box-like structure to be introduced in a proper manner (FIGS. 17*a* and 17*b*).

The functioning of the obstacle protector means is dependent upon the manner in which the collision with the structure proceeds. In a collision a distinction may be made between a head-on collision and a lateral collision. A head-on collision may be still further differentiated into a centric, an eccentric and an angular collision. In the event of a centric collision, first the nose apron C' of the structure will deform. Thereupon, the support member G' will start sliding freely with its feet in the foundation guide member H, and the two flank members C will be pushed backwards. Simultaneously, the first box-like structure will be compressed. The subsequent segments A will be compressed in succession. The number thereof depends upon the magnitude of the quantity of kinetic energy to be dissipated.

The deceleration of the vehicle is determined by:

(a) the ripple resistance of the ripple tubes;

(b) the acceleration of masses (segments A and A' and flank members C);

(c) several other resistance factors such as:

the deforming resistance of the nose segment A', the mutual friction of the flank members C, the rolling and sliding resistance of the support members G and the resistance factors of the vehicle itself.

Due to the influence of the mass inertia and occurent frictions in the structure, the segments will deform one by one. The plates $P_1$ and $P_2$ of the box-like structure N are so designed during a head-on collision the upper plate $P_1$ can freely bend upwards and the lower plate $P_2$ can freely bend downwards (see FIG. 9). Such upward and downward bending quality is important so as to prevent the tubes from being struck by the lower plate $P_2$ or upper plate $P_1$ during impact. In order to ensure this shape, the box N is internally provided with spacer means S. The lower and upper plates $P_2$ and $P_1$, respectively, can absorb tensile forces in the event of a lateral collision. The spacer means S are also advantageous in preventing damage due to vandalism committed by passersby climbing upon the obstacle protector means. The ripple tubes B in the box N are centered and fixedly secured on the frontal face of the box N by means of spiders M. On the back side they are confined in apertures 20 provided in the back plate Q of the box N. By premounting the ripple tubes B, errors are avoided when assembling the structure.

The support members G FIGS. 1 and 3 are so designed as to afford easy and safe mounting of the boxes N through bolt holes 21 on the upper and lower sides, see FIG. 9. The wheels R on the legs of the support members G ensure a smooth displacement of the support members in the longitudinal direction of the structure.

Figure 6:
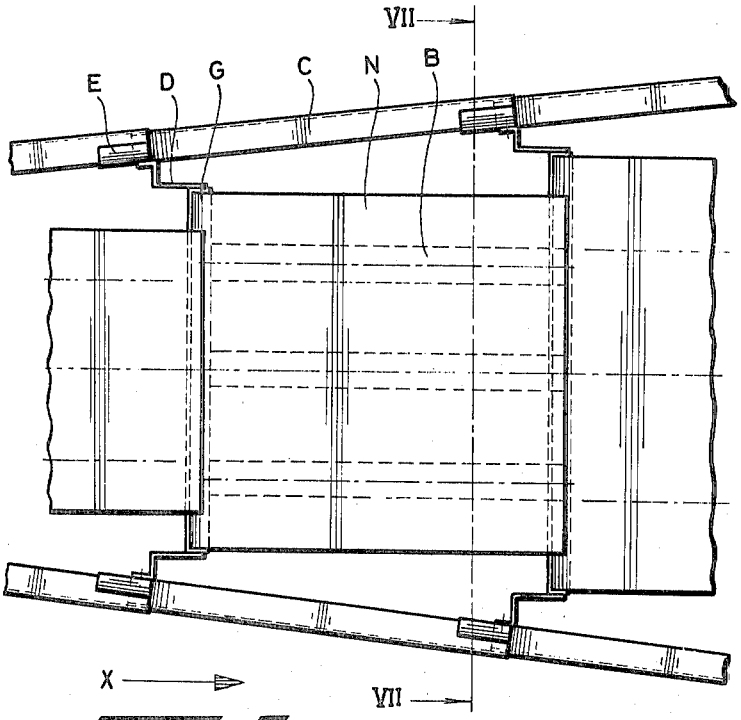
FIG. 6 shows, on an enlarged scale, a detail of the arrangement as per FIG. 1.
Figure 7:
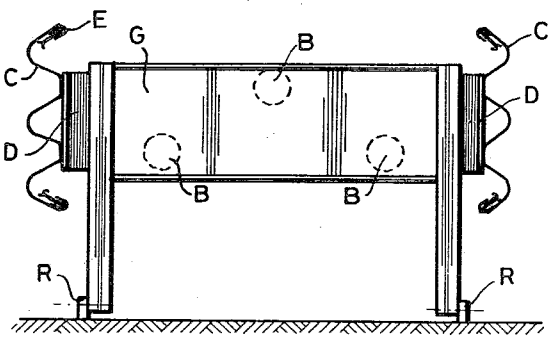
FIG. 7 is a sectional view taken along line VII—VII in FIG. 6.

The flank members C have a length of more than twice the length of one segment. They overlap each other, via FIGS. 6, 11 and 12 by means of a guide flange E (see FIGS. 1 and 7), mounted on or formed integrally with the back side of the top of each flange member C and disposed over the next flank member. The flank members C can slide passing one another without there being the danger of a secondary collision of the guide retainer E with the flank member of the following segment, because they have already passed one another in the original position. The advantage of a great length of overlapping is that it increases the lateral and vertical stability of the whole structure.

The flank members C are connected to the support members G by means of angled strips D (FIGS. 10–12). The strips D afford the flank members C a certain amount of movability with respect to the support member(s) G. This is necessary because in the event of a head-on collision and the successive telescoping of segments:

a. the angle formed by the flank members C with respect to the support members G may change;

b. the distance of the flank members C to the support members G may change; and c. the flank members C must obtain some freedom so as to reduce the influence of mass inertia on the forces in the structure and on the deceleration of the vehicle.

In addition, in the event of a lateral collision:

d. the strips D provide an extra braking path and the flank members C undergo a smooth deformation.

As a result of the form of the angled strips N the movements in the horizontal plane as described can be realized while ensuring sufficient rigidity in the vertical direction. A proper vertical position of the support members G is a condition for the intended behavior of the box-like structure N.

Eccentric head-on collisions are understood to be those collisions in which the longitudinal axis of the vehicle runs parallel to but spaced from the longitudinal axis of the structure. In an angular head-on collision, the longitudinal axis of the vehicle forms an angle with the longitudinal axis of the structure.

Figure 8A:
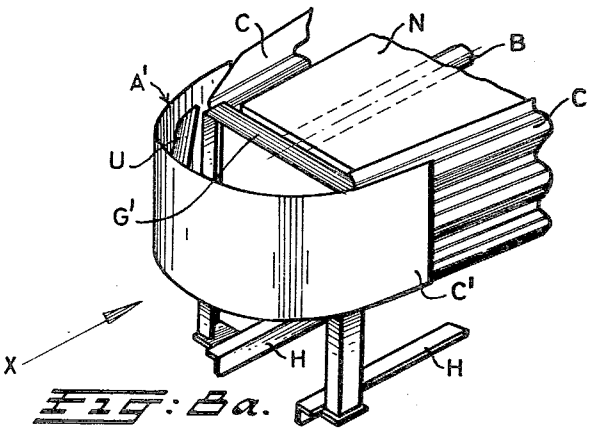
FIGS. 8*a* and 8*b* provide a perspective view and a front view, respectively, of a nose segment of the obstacle protector means according to the invention.
Figure 8B:
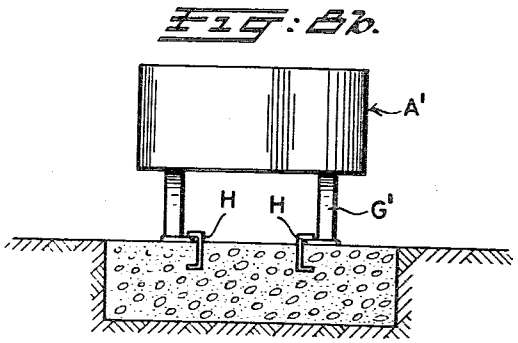

If the vehicle strikes the obstacle protector means eccentrically or at an angle, the nose apron A′ is intended to be deformed in such a way that the vehicle is not thrown back. To this end the nose apron A is provided with straight thin plates U (FIGS. 1 and 8*a*). Relative to their points of fastening, the plates U are capable of absorbing tension but no pressure. As a result, the nose segment will be inclined to hold the vehicle. (see FIGS. 17*a* and 17*b*).

Figure 13:
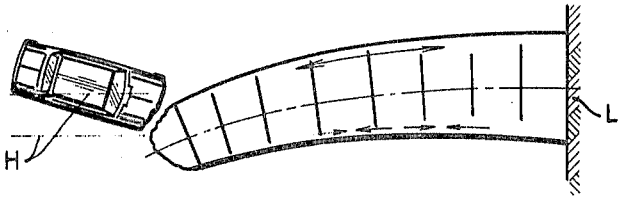
FIGS. 13 and 14 illustrate two situations arising in the event of a collision.
Figure 14:
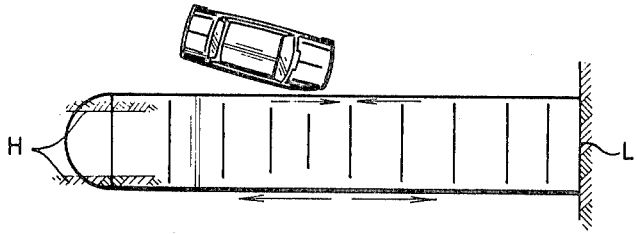

If, in an eccentric or angular collision, the displacement in longitudinal direction is so large that the support member G′ leaves the foundation guide member H, the whole obstacle protector structure is to be regarded as a projecting girder with respect to the supporting foundation L (see FIG. 13). The box-like structure N can absorb this force couple.

Figure 5:
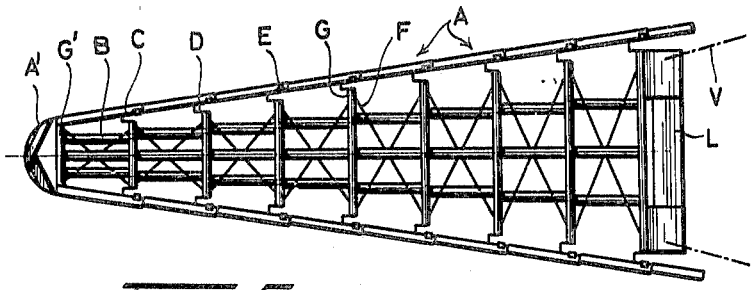
FIG. 5 is a top view of an alternative form of the arrangement shown in FIGS. 1 and 2.

Another type of collision is a lateral collision. These collisions concern impacts of collision upon the flank of the obstacle protector means. In such an event the whole obstacle protector means forms a beam having as points of support the ground rail H and the supporting foundation L. The upper and lower plates $P_1$ and $P_2$ of the box N act, in the tension zone, as tension absorbers. The ripple tubes B act, in the pressure zone, as pressure absorbers (see FIG. 14). The foregoing describes the obstacle protector means having a box-like structure. This box-like structure N is an essential element for increasing the stability of the structure. An alternative form of embodiment for obtaining the stability is attained by replacing the box-like structure N by two crossed tension rod members F. (see FIG. 5). This alternative embodiment essentially functions in a manner identical with that of the form of embodiment having the box-like structure N. This form of construction with tension rod members likewise can be realized in a V-form and a parallel form.

Figure 15:
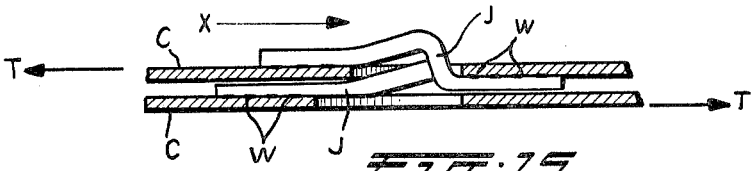
FIG. 15 shows a construction enabling the absorption of occurrent tensile forces into a flank member of the alternative form of the embodiment as per FIG. 5.

The construction of the segments of this alternative embodiment is as follows. Between the support members G there are provided individual tubes B, whereupon parallel adjustment is effected by means of the tension rod members F. In the event of a lateral collision the compressive forces are again absorbed by the tubes B. Tensile forces are absorbed by the tension rod members F and the flank members C. For this purpose the flank members C have been internally provided with members J to prevent shifting under tension during lateral collision (FIG. 15). The members J are secured to opposed ends to the spaced flank members C by welds W to resist movement of the flank members C in a tension direction T. For the purpose of increasing the stability the crossed tension rod members may be connected together in the center.

Although the present invention has been shown and described in connection with preferred embodiments thereof, it will be apparent to those skilled in the art that many variations and modifications may be made without departing from the invention in its broader aspects. It is therefore intended to have the appended claims cover all such variations and modifications as all are within the true spirit and scope of the invention.

What is claimed is:

1. An arrangement for protecting an obstacle, the arrangement comprising a deformable spatial structure wherein a dissipation of energy is brought about a deformation resulting from a collision with a moving object, the deformable spatial structure comprising:

a straight series of segments, the segments being interconnected along a central axis lying in the direction of anticipated motion, each segment including:

at least one inverted U-shaped support member standing on the ground and positioned transversely to the central axis:

a box-like structure fastened to the U-shaped member;

a plurality of crumpling tubes disposed within the box-like structure extending in the direction of the central axis; and a pair of flank members affixed on both sides of each segment, the flank members having free ends slidingly overlapping the flank members of adjacent segments;

the support member of the last segment viewed in the direction of anticipated motion being fixedly secured to the ground;

a horizontal guideway parallel to said central axes disposed on the ground and receiving only the support member of the first segment to allow displacement of the first support member only in the direction of the central axis; and wherein the segments are coupled to one another so that under lateral forces acting thereon, the deformable spatial structure behaves like a rigid girder supported at the last segment end, but is collapsible under head-on collisions along the central axis.

2. The arrangement according to claim 1 wherein:

the box-like structure includes an upper plate and a lower plate, both of which are bent outwardly from each other;

the upper and lower plates of each box-like structure having front and rear edges; and means, provided on the front and rear edges of each of the upper and lower plates, for securing each of the upper and lower plates to adjacent support members so as to increase the resistance against bending in a horizontal plane.

3. The arrangement according to claim 1 and wherein;

the box-like structures of successive segments from the first to the last segment include crumpling tubes having increasing deformation resistance.

4. An arrangement for protecting an obstacle, the arrangement comprising a deformable spatial structure wherein a dissipation of energy is brought about during a deformation resulting from a collision with a moving object, the deformable spatial structure comprising:

a straight series of segments, the segments being interconnected along a central axis lying in the direction of anticipated motion, each segment including;

at least one inverted U-shaped support member standing on the ground and positioned transversely to the central axis;

a box-like structure fastened to the Ushaped member, the box-like structure including upper and lower plates, both of which are bent outwardly from each other;

at least one rod mounted vertically between the upper and lower plate;

a plurality of crumpling tubes disposed within the box-like structure extending in the direction of the central axis, the crumpling tubes of each successive segment when viewed in the direction of anticipated motion providing increasing deformation resistance; and a pair of flank members affixed on each side of each segment, the flank members having free ends slidingly overlapping the flank members of adjacent segments;

the support member of the last segment being fixedly secured to the ground;

a horizontal guideway parallel to said central axis disposed on the ground and receiving only the support member of the first segment to allow displacement of the first support member only in the direction of the central axis; and wherein the segments are coupled to one another so that under lateral forces acting thereon, the deformable spatial structure behaves like a rigid girder supported at the last segment but is collapsible under head-on collisions along the central axis.

5. The arrangement according to claim 4, characterized in that each segment is provided with flank members having longitudinal undulations, said flank members extending beyond the extremities of each segment in overlapping relationship with the flank members of adjacent segments, at least one double-angled strip means for connecting each flank member to a support member, the strip means affording a change in the mutual position of adjacent flank members with respect to each other during a collision, but no substantial change in the orientation of the flank members with respect to the associated support member, and a flange mounted on the top of each flank member and slidingly receiving the adjacent flank member to form a guide when the flank members are sliding past each other.

6. The arrangement according to claim 5, characterized in that the first segment viewed in the direction of anticipated motion is provided with a plate bent about the front end of the first segment forming a nose apron, and a plurality of strips secured behind the nose apron in a crosswise arrangement.

* * * * *